United States Patent [19]

Wichinsky

[11] 4,236,717

[45] Dec. 2, 1980

[54] GAME MACHINES

[75] Inventor: Michael Wichinsky, Las Vegas, Nev.

[73] Assignee: Bell-Fruit Manufacturing Co. Limited, Nottingham, England

[21] Appl. No.: 948,657

[22] Filed: Oct. 5, 1978

[30] Foreign Application Priority Data

Oct. 11, 1977 [GB] United Kingdom ..... 42198/77

[51] Int. Cl.[3] ..... A63F 5/04

[52] U.S. Cl. ..... 273/143 R

[58] Field of Search ..... 273/143 R, 143 A, 143 B, 273/143 C, 143 D, 143 E, 138 R, 138 A; 194/DIG. 11

[56] References Cited

U.S. PATENT DOCUMENTS

| | | | |
|---|---|---|---|
| 3,642,287 | 2/1972 | Lally et al. | 273/143 R |
| 4,051,939 | 10/1977 | Murphy et al. | 273/143 R X |
| 4,058,026 | 11/1977 | Simpson | 194/DIG. 11 X |

FOREIGN PATENT DOCUMENTS

| | | | |
|---|---|---|---|
| 1292712 | 10/1972 | United Kingdom | 273/143 R |
| 1359852 | 7/1974 | United Kingdom | 273/143 R UX |
| 1471866 | 4/1977 | United Kingdom | 273/143 R |
| 1535095 | 12/1978 | United Kingdom | 273/143 R UX |

*Primary Examiner*—Richard C. Pinkham
*Assistant Examiner*—Arnold W. Kramer
*Attorney, Agent, or Firm*—Scrivener, Parker, Scrivener and Clarke

[57] ABSTRACT

A gaming machine of the kind in which a combination of symbols is selected at random by spinning and stopping each of a set of coaxial reels, each reel carrying a plurality of symbols around its periphery and serving to display at least one of these symbols in a display window when stationary, characterized in that the reels are spun by a drive mechanism comprising a lever operated mechanism through which the work done by a player in operating a lever is transferred to the reels so as to spin them, and electrical powered drive means including a motor driven shaft on which the reels are rotatably mounted and to which they are frictionally coupled through individual slipping clutches. Preferably, the lever, when operated by a player, triggers operation of the electrical powered drive means so that the reels are spun by both the lever operated mechanism and the electrical powered drive means. Operation of the electrical powered drive means may also be controlled by one or more player operated devices separate from said lever, whereby a player can spin one or more of the reels.

12 Claims, 6 Drawing Figures

GAME MACHINES

Figure 1:
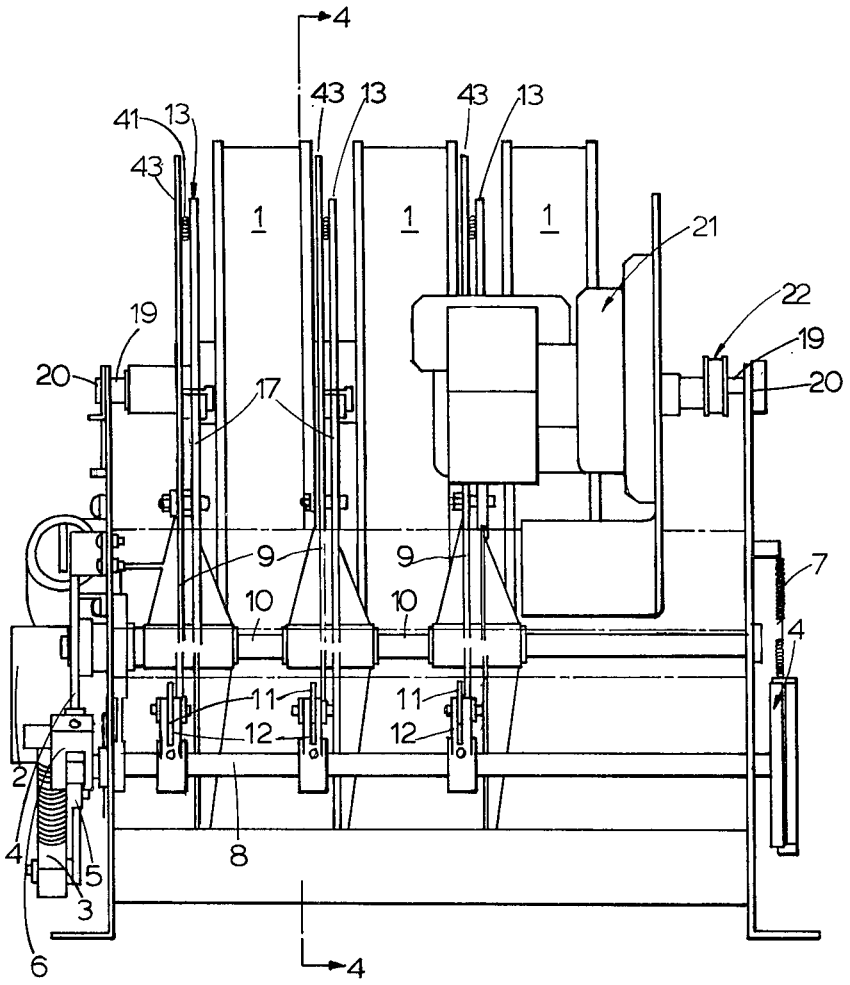

This invention relates to gaming machines of the kind in which a combination of symbols is selected at random by spinning and stopping each of a set of coaxial reels, each reel carrying a plurality of symbols around its periphery and serving to display at least one of these symbols in a display window when stationary.

Broadly speaking, gaming machines of the aforesaid kind can be divided into two classes according to the manner in which the reels are set spinning. One class of machine is that of the mechanically actuated machine in which the player operates a lever to load and trigger a kicker mechanism that spins the reels; and the other class is that of the electrically actuated machine in which an electric motor rotates a drive shaft on which the reels are rotatably mounted and which in turn spins each reel through a respective slipping clutch.

The electrically actuated machine has superseded the mechanically actuated machine in some markets, and has led to the development of machines incorporating special features whereby one reel is rotated while another is held stationary, this being made possible by theslipping clutches. For example, some machines incorporate a "hold feature", whereby reels displaying favourable symbols can be held stationary while others are spun in an attempt to complete a prize-winning combination of symbols; and others incorporate a "nudge feature", whereby any reel can be indexed independently of the other reels so as to exchange the symbol in the display window for the next in order on that reel. These special features enhance the enjoyment of players by offering them a wider variety of games and also the opportunity of making choices in a game so as to determine the result.

On the other hand, the mechanically actuated machine is the more traditional mechanism and for this reason alone is preferred in some markets, even though it allows only one basic type of game to be played in which the reels are spun and stopped and a prize awarded according to the combination of symbols displayed.

The two classes of machine also differ in that the mechanically actuated machine relies on the reels being free running so that they do not slow up appreciably while spinning, whereas the reels in the electrically actuated machine are continuously driven while they spin. Thus, the sensor means that senses the positions of the reels in order to detect prize-winning combinations of symbols in the mechanically actuated machine, is limited to those means that do not impede rotation of the reels, whereas the commonest form of sensor means used in the electrically actuated machine comprises simple, rotary switch means associated with each reel in which an electrical wiper and a contact board are in constant spring engagement and rotate relative to one another with rotation of the reel, thereby producing resistance to the rotation of the reel which is overcome by the reel motor.

According to the present invention we propose a gaming machine of the aforesaid kind in which the reels are spun by a drive mechanism comprising a lever operated mechanism through which the work done by a player in operating a lever is transferred to the reels so as to spin them, and powered drive means including a motor driven shaft on which the reels are rotatably mounted and to which they are frictionally coupled through individual slipping clutches.

The lever operated mechanism may comprise a substantially conventional kicker mechanism having individual kicker arms each engageable with a notched kicker disc fastened to a respective reel and all being operated simultaneously to spin the reels by the action of a spring mechanism loaded and triggered by the lever when operated by the player. Preferably, however, the kicker mechanism is adapted so that it triggers energisation of the drive motor as it is operated, the drive motor then continuing to drive the reels once the kicker mechanism has operated to spin the reels. Thus, although the reels are still spun by a manually loaded kicker mechanism, their rotation is maintained by the drive motor so that they will not slow down appreciably even if sensor means of the rotary switch type is employed.

Further, because the reel drive mechanism according to the invention includes powered drive means, it offers the possibility of the reels being rotated independently of the kicker mechanism so that the machine can incorporate special features such as the "nudge feature". Each reel is provided with a stop mechanism that takes the form of a solenoid-operated arm engageable with any one of a plurality of notches in a notched disc (possibly the kicker disc) fastened to the reel. Normally, the solenoids are energised simultaneously to release the reels after the kicker arms have engaged the kicker discs, but before the kicker arms have been triggered to spin the reels; the kicker arms themselves holding the reels against rotation while they engage the kicker discs. However, it is a simple matter to arrange that the solenoids can additionally be energised independently of one another and the kicker mechanism so that the respective reels can be released for rotation by the drive motor alone.

Figure 2:
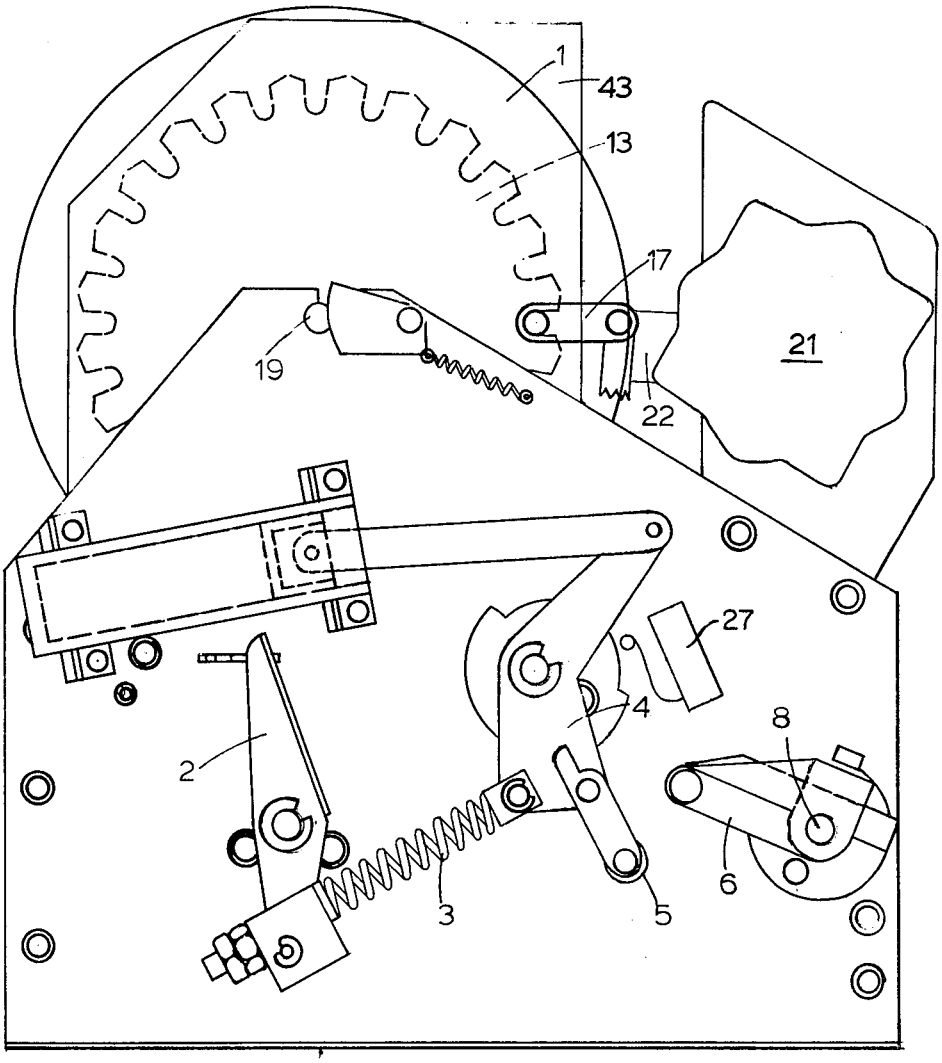
Figure 3:
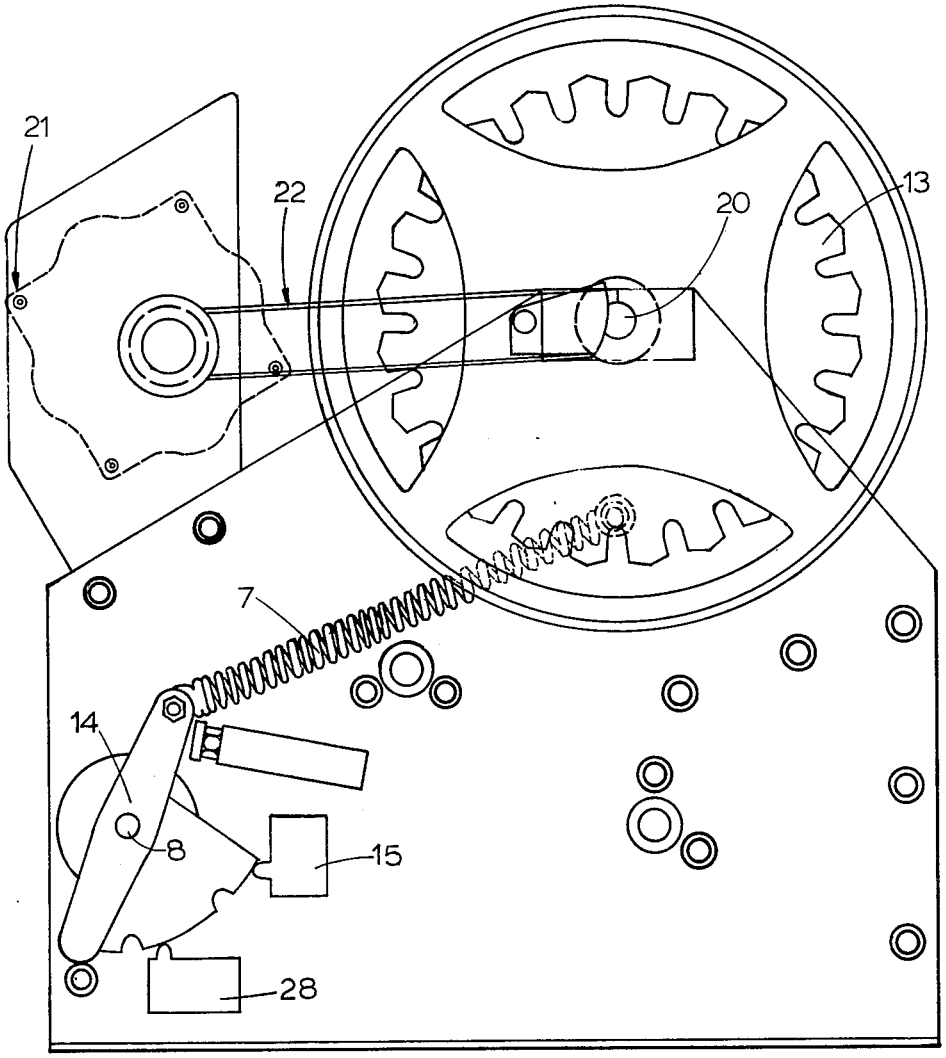
Figure 4:
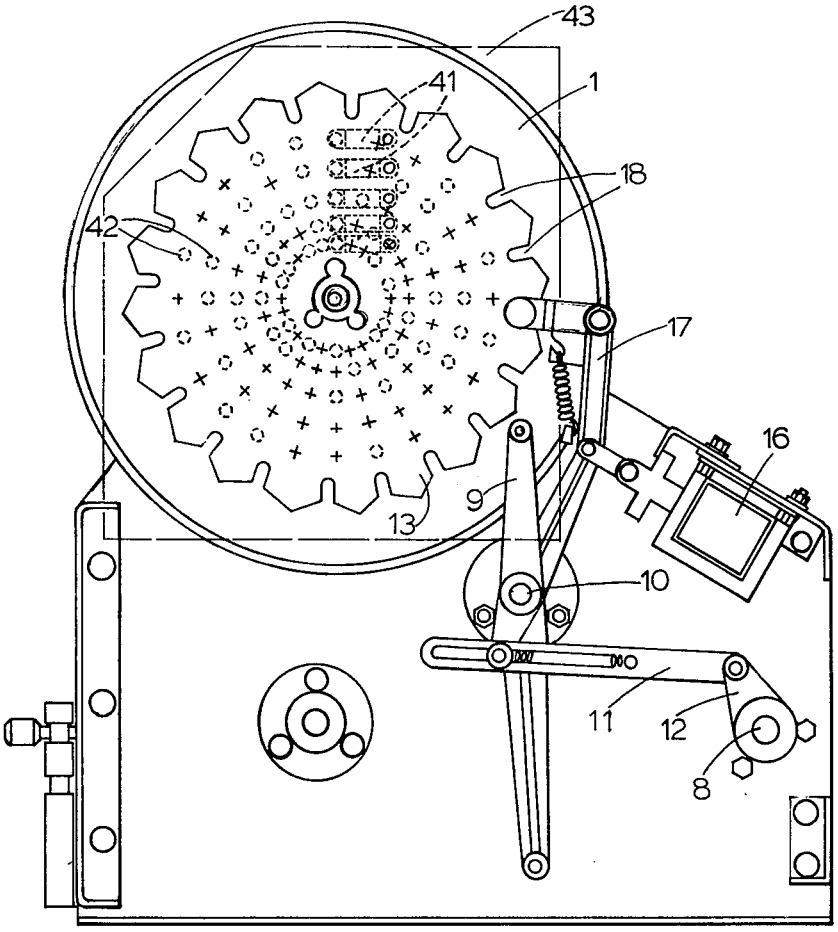
Figure 5:
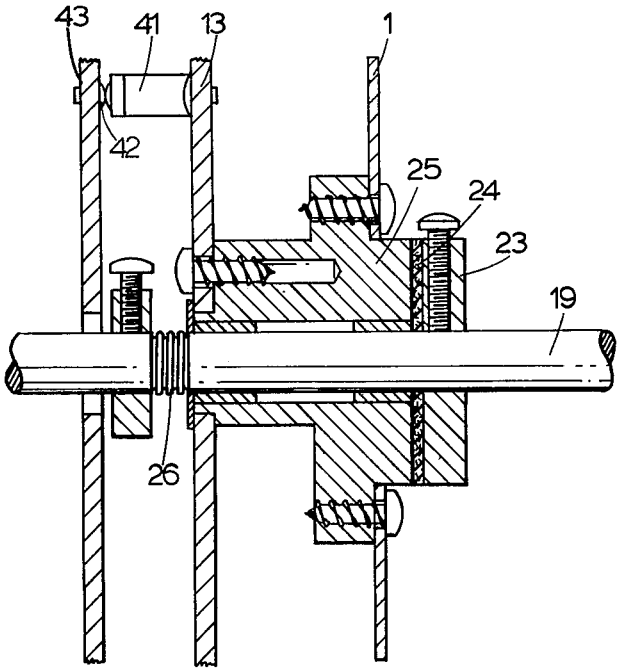
Figure 6:
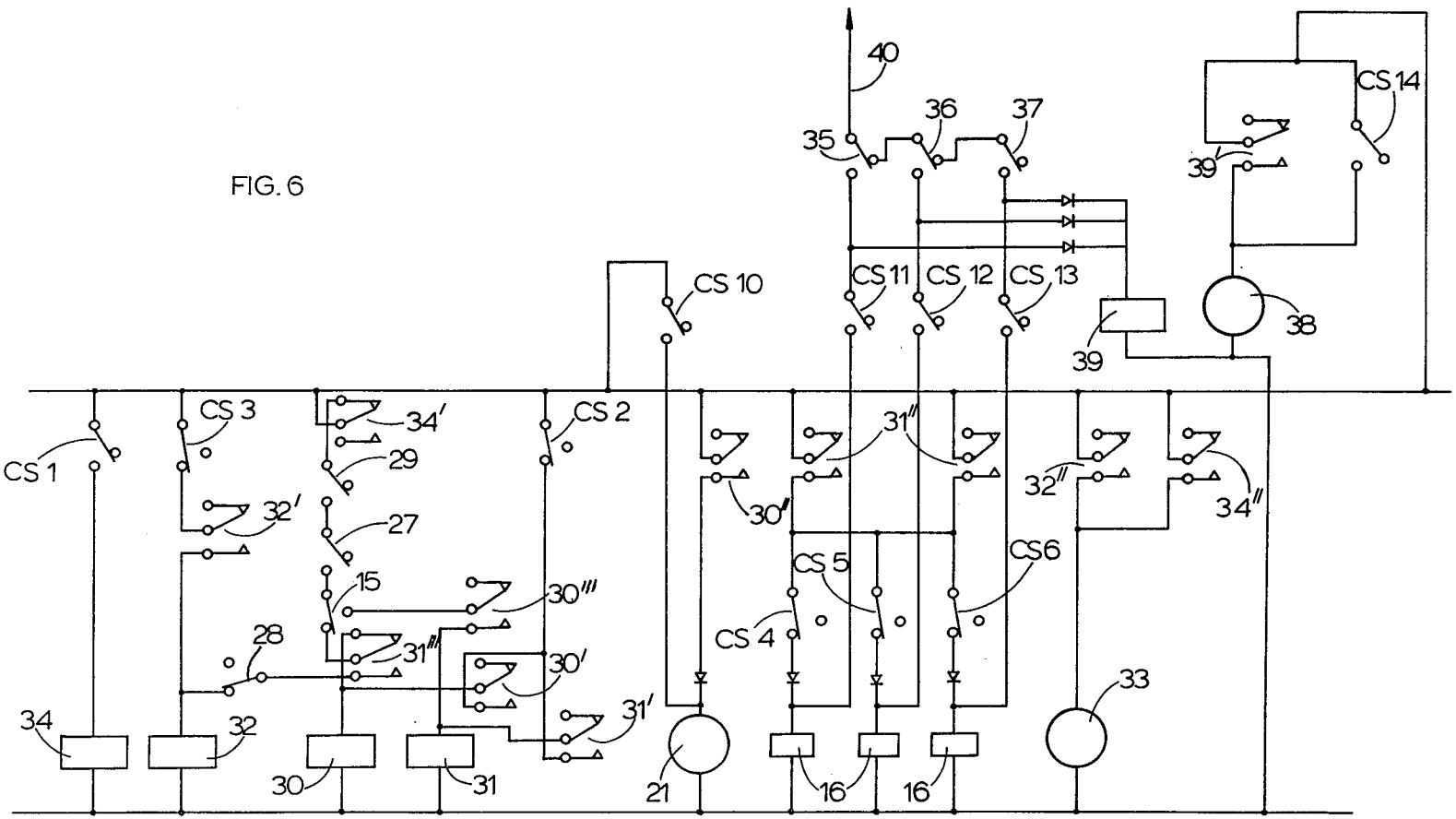

The invention will now be described by way of example with reference to the accompanying drawings in which:

FIG. 1 is a side elevation of a reel assembly for a gaming machine according to the invention, FIG. 2 is an end elevation of the reel assembly of FIG. 1, as seen from the left-hand end, FIG. 3 is an end elevation of the reel assembly of FIG. 1, as seen from the right-hand end, FIG. 4 is an elevation along the line 4—4 in FIG. 1, FIG. 5 is an enlarged view of part of FIG. 1 showing the slipping clutch between a reel and the drive shaft, and FIG. 6 is a circuit diagram for the reel assembly of FIGS. 1 to 5.

FIGS. 1 to 6 illustrate a reel assembly for a gaming machine according to the invention incorporating a kicker mechanism to spin three co-axial reels 1. Briefly, the kicker mechanism comprises an operating lever 2 which the player pivots anti-clockwise as seen in FIG. 2 to operate the machine. Lever 2 is connected via a link 3 to a pivoted plate 4 carrying a roller 5 which co-operates with a pivoted cam 6 so that the operating movement of lever 2 turns cam 6 and its shaft 8 clockwise against the action of a loading spring 7 (FIG. 3) which acts on the opposite end of shaft 8 from cam 6.

An individual kicker arm 9 is associated with each reel and is pivotally mounted on a common shaft 10 and connected through a link 11 to an arm 12 on shaft 8 so that operation of shaft 8 by the operating lever 2 turns the kicker arms 9 into engagement with respective notched kicker discs 13 fastened to the reels 1. At this point, a cam arm 14 on shaft 8 operates a microswitch 15 which causes energisation of the solenoids 16 of the stopping mechanism associated with each reel. The stopping mechanism comprises a stop arm 17 that engages one of the notches 18 in the kicker disc 13 and which is withdrawn therefrom when the solenoid 16 is energised.

Over the final part of the operating movement of lever 2, roller 5 disengages cam 6, and the latter together with shaft 8 and arms 12 is turned rapidly counter-clockwise (FIG. 2) by the fully loaded spring 7. This movement is transferred via links 11 to the kicker arms 9 which thus turn rapidly clockwise and spin the reels 1 as they disengage the notches 18 in the kicker discs 13.

In a conventional mechanism, the reels all rotate on a fixed shaft 19. However, the illustrated mechanism is modified so as to incorporate the present invention by making the shaft 19 motor driven and providing a slipping clutch connection between each reel 1 and the shaft 19. The shaft 19 is mounted in bearings 20 at opposite ends (FIG. 1) and is driven by an electric motor 21 via a belt and pulley arrangement 22 at one end (FIG. 3). Each clutch connection (FIG. 5) comprises a collar 23 fastened to shaft 19, and a clutch disc 24, typically made of leather, that is sandwiched between collar 23 and a boss 25 of the reel by the action of a compression spring 26 that encircles shaft 19.

A microswitch 27 is provided which is operated by the lever 2 and which when operated serves to energise the motor 21. The shaft 19 is therefore driven, but the drive is not transferred to the reels until the kicker mechanism is operated to release the reels via microswitch 15 and spin them. Prior to this time, the reels are held stationary either by the stop arms 17 or by engagement of the kicker arms 9 in the notches 18 of the kicker discs 13.

A further micro-switch 28 is provided which is operated by the cam arm 14 and serves to initiate operation of a cam programmer on the return stroke of the lever 2, the programmer serving to control a game cycle including de-energisation of the stop solenoids 16 to stop each of the three reels in turn. Operation of the electrical control circuitry of the machine will be described with reference to FIG. 6.

The switches 15 and 27 are connected in series with a credit switch 29 to control energisation of a motor relay 30 and a reel relay 31 that control operation of the reel motor 21 and stop solenoids 16, respectively. FIG. 6 shows the state of the switches when the lever 2 is unoperated and there are no game credits available. If a player inserts a coin or token into the machine, a game credit is registered and the credit switch 29 is closed. If the player then operates the lever 2 to initiate a game, the switches 27, 15 and 28 operate as follows.

Firstly, switch 27 closes and completes a circuit to energise the motor relay 30, having relay contacts 30' that close to hold the relay energised via a programmer cam switch CS2, relay contacts 30'' that close to operate the motor 21, and relay contacts 30''' that close to make a circuit from switch 15 to the reel relay 31.

Switches 15 and 28 then operate, switch 15 making a circuit via the closed contacts 30''' to energise the reel relay 31. The energised reel relay 31 has relay contacts 31' that close to hold the relay energised via the programmer cam switch CS2, relay contacts 31'' that close to energise the three stop solenoids 16 via the respective programmer cam switches CS4, CS5 and CS6, and relay contacts 31''' that close to connect the now open contact of the switch 15 to the switch 28.

At this time, switch 28 has been operated and is therefore in the open state, but when the lever 2 makes its return stroke, switch 28 and switch 15 return to their illustrated positions and complete a circuit through the relay contacts 31''', switch 27, and credit switch 29 to energise a start relay 32. This happens only momentarily before the switch 27 is released by the lever 2 and returns to its illustrated position, but during this time the start relay 32 operates its relay contacts 32' to hold itself energised and relay contacts 32'' to energise the motor 33 of the cam programmer.

Thus, operation of lever 2 energises the motor relay 30 to start the reel motor 21, energises the reel relay 31 to release the reels so that they are free to spin, and energises the start relay 32 to start the cam programmer. The programmer then controls the game cycle through the cam switches CS1 to CS6, as follows.

Cam switch CS1 closes first to energise a game relay 34 and remains closed during the whole of the game cycle. The energised game relay 34 operates relay contacts 34' in series with the credit switch 29 and switches 15 and 27 so that further operation of the lever 2 is rendered ineffective. Relay contacts 34'' also close to energise the programmer motor 33 independently of the start relay contact 32''. Thus, when the next cam switch to be operated, cam switch CS3, is opened momentarily, the start relay 32 is de-energised and relay contacts 32'' open, but the programmer motor 33 continues to operate.

Cam switches CS4, CS5 and CS6 operate next, one after the other in this order, thereby de-energising the respective solenoids 16 so that the stop mechanisms stop rotation of the reels 1. The cam switch CS2 then opens momentarily to de-energise the motor relay 30 and reel relay 31, and finally the cam switch CS1 opens to de-energise the game relay 34. Thus, the reel motor 21 and programmer motor 33 both stop and the circuitry is then in the re-set condition shown in FIG. 6.

The illustrated gaming machine is also adapted so as to incorporate the "nudge feature", whereby at predetermined times a player can operate a nudge switch 35, 36, 37 associated with each reel 1 so as to index the reel by one symbol position. Each nudge switch causes energisation of the stop solenoid 16 of the associated reel and operation of the reel motor 21 in a predetermined manner, as controlled by a further cam programmer comprising a motor 38 and cam switches CS10 and CS14.

The "nudge feature" may be made available at random, power being connected to line 40 when the "nudge feature" is available. Operation of a nudge switch 35 to 37 then energises a nudge start relay 39 having relay contacts 39' that close to energise the programmer motor 38. The programmer then operates to close cam switch CS14 so as to hold the motor 38 energised for a complete nudge cycle. During this cycle cam switch CS10 closes to energise the reel motor 21, and cam switches CS11 to CS13 close momentarily to cause that solenoid 16 associated with the operated nudge switch 35 to 37 to be energised. The respective stop mechanism therefore releases its reel long enough for it to be rotated one symbol position by the reel motor 21. The cam switch CS10 then opens again to stop the reel motor 21, and cam switch CS14 opens to stop the cam programmer.

Indexing of a reel in this manner, enables a player to move a reel by one symbol plane so as to exchange one symbol on a prize-line display window with the next symbol in order on that reel, which symbol may already be visible in the display window. Therefore, a player can operate the nudge switches 35 to 37 so as to build-up a prize-winning combination of symbols on the prize-line.

FIGS. 4 and 5 show sensor means for sensing the different stop positions of each reel 1 comprising a set of wiper arms 41 connected to the respective kicker disc 13 and which each resiliently engages a ring of contacts 42 on a board 43 fixed adjacent the reel. The contacts 42 for the different reels may be connected in series circuits which are completed by the wiper arms 41 to signal a win, or each set of wiper arms 41 may produce a digital coded signal for each stop position, this signal being fed to a decoder which detects prize-winning combinations. The cam programmers for controlling the game cycle and the nudge cycle are adapted so as to control searching for prize-winning combinations and the award of corresponding prizes.

It will be appreciated that the constant engagement of the contact arms 41 with the contact boards 43 produces resistance to rotation of the reels but that this is overcome by the driving action of the motor 21.

In an alternative embodiment of the invention, the motor 21 is not used to drive the reels when a player operates lever 2. The microswitch 27 and motor relay 30 are omitted and the illustrated sensor means is replaced by alternative sensor means, such as photoelectric means or disengageable mechanical means that does not impede rotation of the reels. The reel drive mechanism then spins the reels by a purely mechanical action when a player operates lever 2. However, the motor 21 still operates to index the reels independently of one another when the "nudge feature" is available, as described above.

I claim:

1. A gaming machine comprising a set of co-axial rotatable reels each of which carries a plurality of symbols around its periphery; a display window in which each of said reels displays at least one symbol when stationary; a lever operated mechanism which includes a lever operable by a player and through which the work done by a player in operating said lever is transferred to the reels so as to spin them; electrical powered drive means including (a) an electrical motor driven shaft on which the reels are rotatably mounted and individual slipping clutches through which the reels are frictionally coupled to said shaft so as to be spun thereby so that the reels are spun by the lever operated mechanism and continue to be spun by the electrical powered drive means; and stop means associated with the lever and electrical powered drive means and which operates either to stop or release the reels for spinning.

2. A machine as claimed in claim 1 in which said stop means comprises individual stop means associated with each reel to hold it against rotation, and in which said lever, when operated by a player, actuates the stop means to release the reels.

3. A machine as claimed in claim 2 which includes control means that is triggered by operation of said lever so as to perform a control cycle in which it causes the stop means to release the reels so that they spin and then causes the stop means to stop the reels rotating.

4. A machine as claimed in claim 3 in which the control means controls operation of the electrical powered drive means.

5. A machine as claimed in claim 4 in which the control means comprises a first switch device that is operated by the lever and when operated, triggers operation of the electrical powered drive means, and a second switch device that is operated by the lever after said first switch device and, when operated, causes the stop means to release the reels.

6. A machine as claimed in claim 3 in which the control means comprises a cam programmer that controls the stop means to stop the reels and controls stopping of the powered drive means.

7. A machine as claimed in claim 6 including switch means which is operated by the return stroke of the lever after operation by a player to spin the reels, and which triggers operation of the cam programmer when operated.

8. A machine as claimed in claim 1 including one or more player operated devices separate from said lever each of which control operation of the electrical powered drive means and the stop means, whereby a player can spin one or more of the reels at the end of a normal play cycle.

9. A machine as claimed in claim 8 in which each of said player operated devices controls operation of the electrical powered drive means and a respective individual stop means so as to initiate rotation of the associated reel when operated by a player.

10. A machine as claimed in claim 9 including second control means operation of which is triggered by each of said player operated devices and which controls the powered drive means and stop means so that the reel associated with an operated device is indexed by a present amount.

11. A machine as claimed in claim 10 in which the second control means is such that said reel is indexed by one symbol position so as to bring one symbol that is visible in the display window onto a prize-line in the display window.

12. A machine as claimed in claim 1 in which sensor means is associated with each reel to sense its stop positions, the sensor means comprising electrical wiper means that resiliently co-operate with an array of electrical contacts and rotate relative thereto with rotation of the reel.

* * * * *